US007377226B2

(12) United States Patent
Choi

(10) Patent No.: US 7,377,226 B2
(45) Date of Patent: May 27, 2008

(54) REMOTELY CONTROLLED APPARATUS FOR RECOVERING LIQUID IN SUNKEN SHIP AND METHOD PERFORMED BY THE SAME

(75) Inventor: Hyek-Jin Choi, Daejeon (KR)

(73) Assignee: Korea Ocean Research and Development Institute (KR)

( * ) Notice: Subject to any disclaimer, the term of this patent is extended or adjusted under 35 U.S.C. 154(b) by 0 days.

(21) Appl. No.: 10/590,516

(22) PCT Filed: Feb. 25, 2005

(86) PCT No.: PCT/KR2005/000529

§ 371 (c)(1),
(2), (4) Date: Apr. 27, 2007

(87) PCT Pub. No.: WO2005/080191

PCT Pub. Date: Sep. 1, 2005

(65) Prior Publication Data

US 2007/0261629 A1 Nov. 15, 2007

(30) Foreign Application Priority Data

Feb. 25, 2004 (KR) ..... 10-2004-0012688

(51) Int. Cl.
*B63G 8/00* (2006.01)
*E02B 15/00* (2006.01)

(52) U.S. Cl. ..... 114/312; 405/60

(58) Field of Classification Search ..... 114/312; 405/60

See application file for complete search history.

(56) References Cited

U.S. PATENT DOCUMENTS 3,822,660 A * 7/1974 Throner, Jr. ..... 114/50
3,831,387 A * 8/1974 Rolleman ..... 405/191
3,890,796 A * 6/1975 Kruger et al. ..... 405/191
4,284,110 A * 8/1981 Divelbiss et al. ..... 141/98
5,775,390 A * 7/1998 Mohn ..... 141/329

FOREIGN PATENT DOCUMENTS

FR 2406605 A1 5/1979
KR 100239829 B1 10/1999

* cited by examiner

*Primary Examiner*—Sherman Basinger
(74) *Attorney, Agent, or Firm*—Cantor Colburn LLP

(57) ABSTRACT

A remotely controlled apparatus for transporting liquid, such as oil, toxic chemicals, or the like, in a tank of a sunken ship to a floating body, without leakage and a method performed by the apparatus are disclosed. An underwater recovery device (100) of the apparatus includes a supporting frame (10), to which a plurality of devices including a linkage (111) are fixed, chucking devices (20) for fixing the underwater recovery device (100) to the sunken ship (500), a grabber (30) for attaching the base plate (80) to the supporting frame (10), DTB systems 40 for attaching the base plate (80) to the sunken ship (500), thrusters (50) for providing a propulsive force so as to attach the supporting frame (10) to the sunken ship (500), a hole cutter (60) for drilling a hole for the recovery of the liquid, and a liquid recovery device (70) for recovering the liquid through the hole drilled in the sunken ship (500).

6 Claims, 9 Drawing Sheets

[Fig. 1]
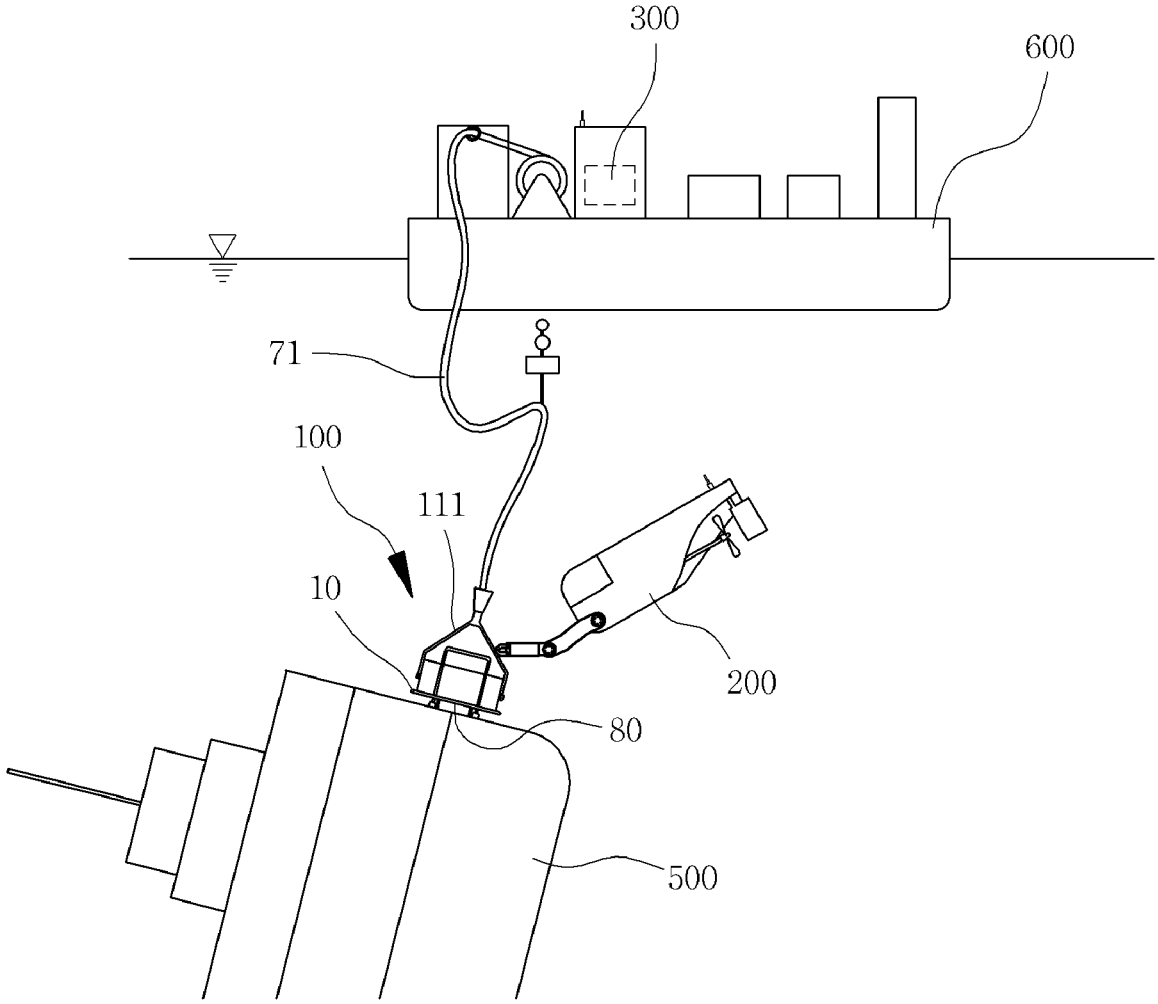

[Fig. 2]
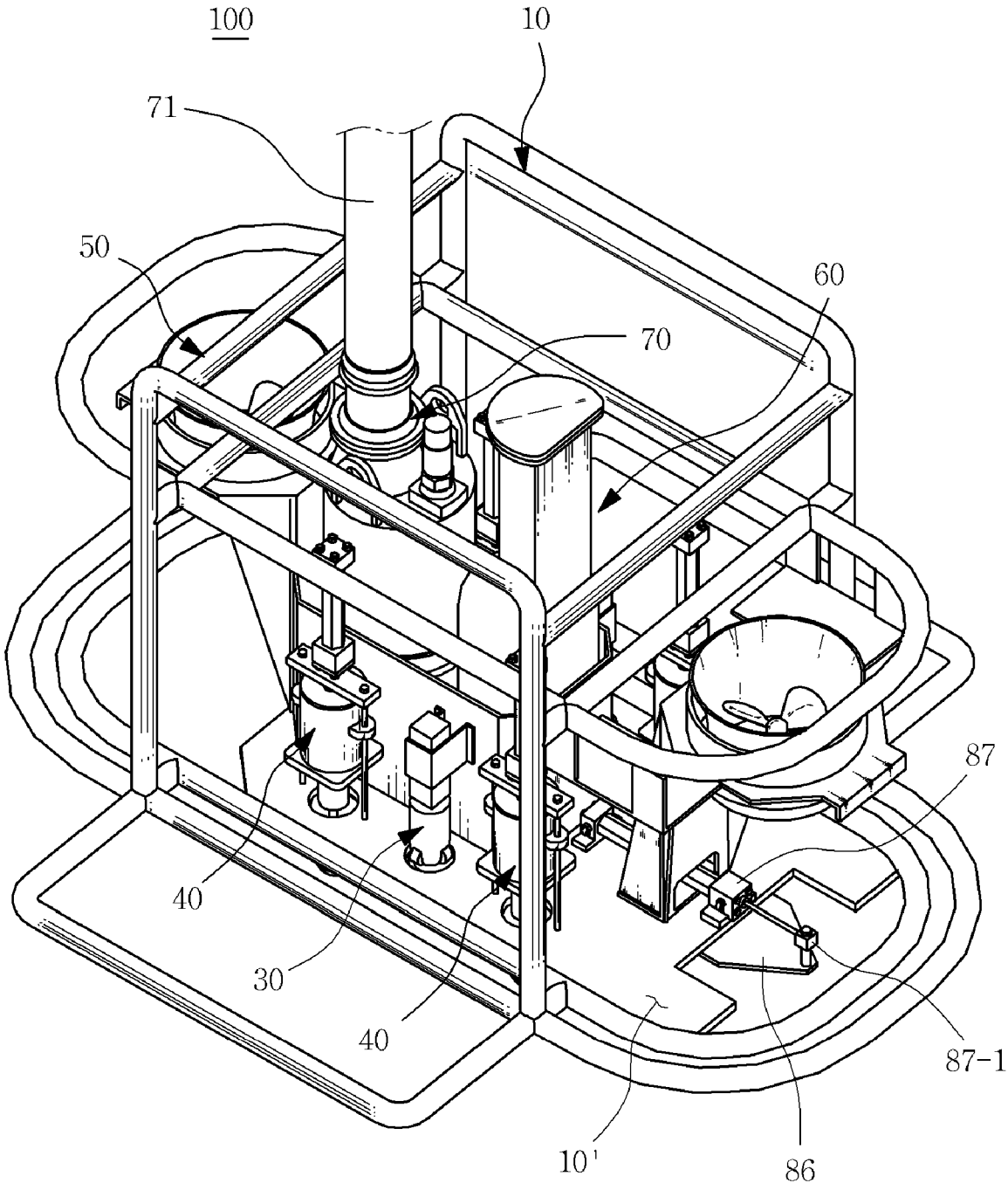

[Fig. 3]
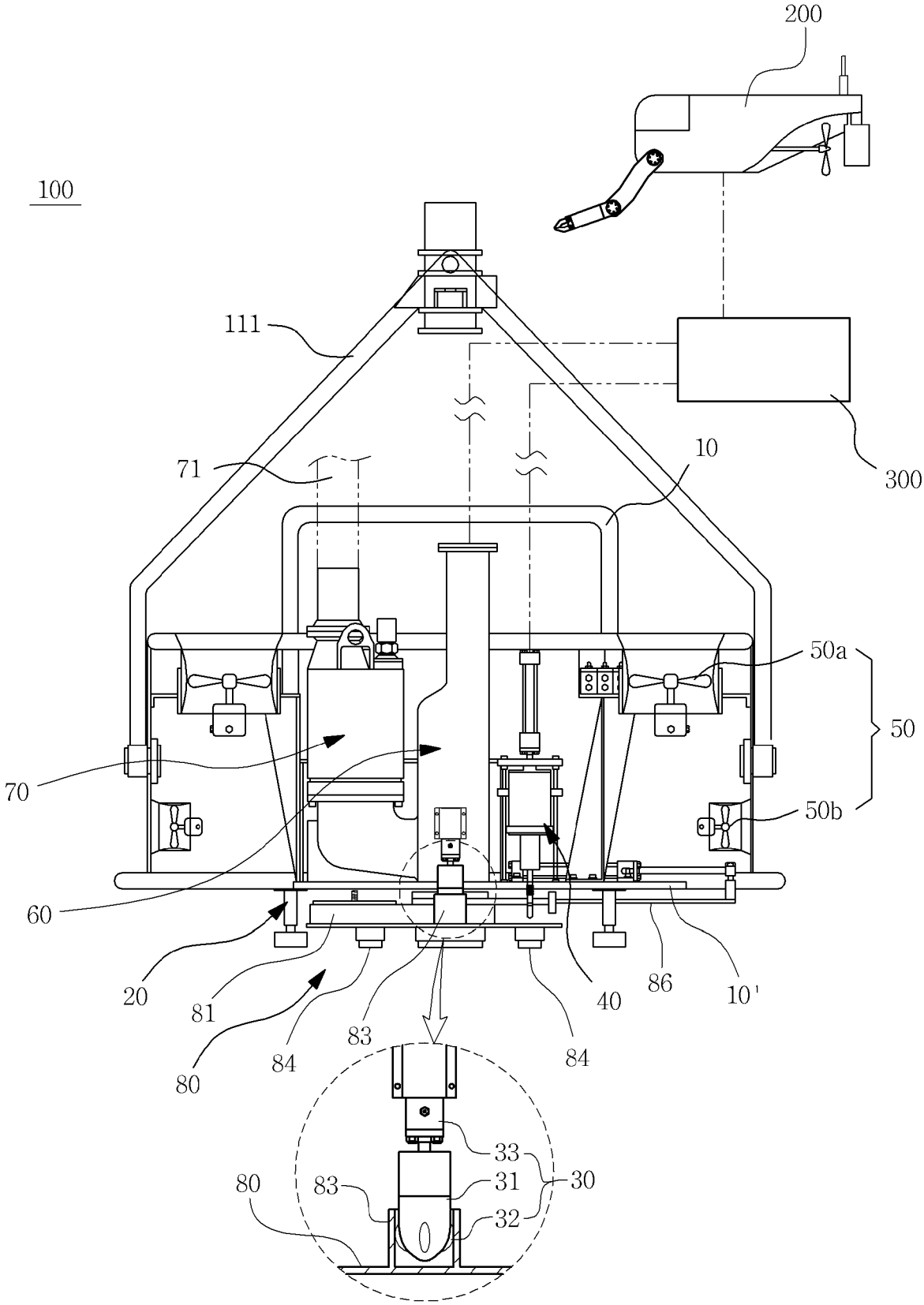

[Fig. 4]
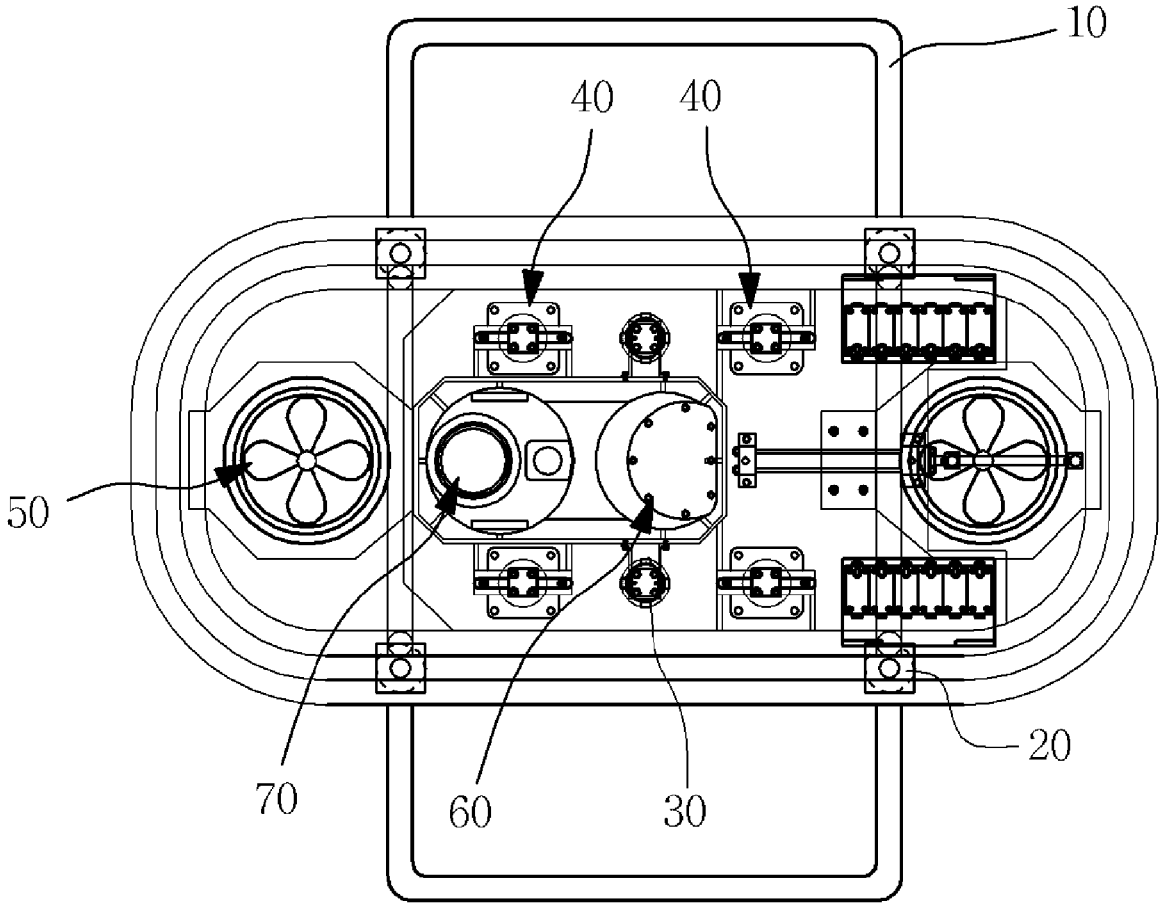

[Fig. 5]
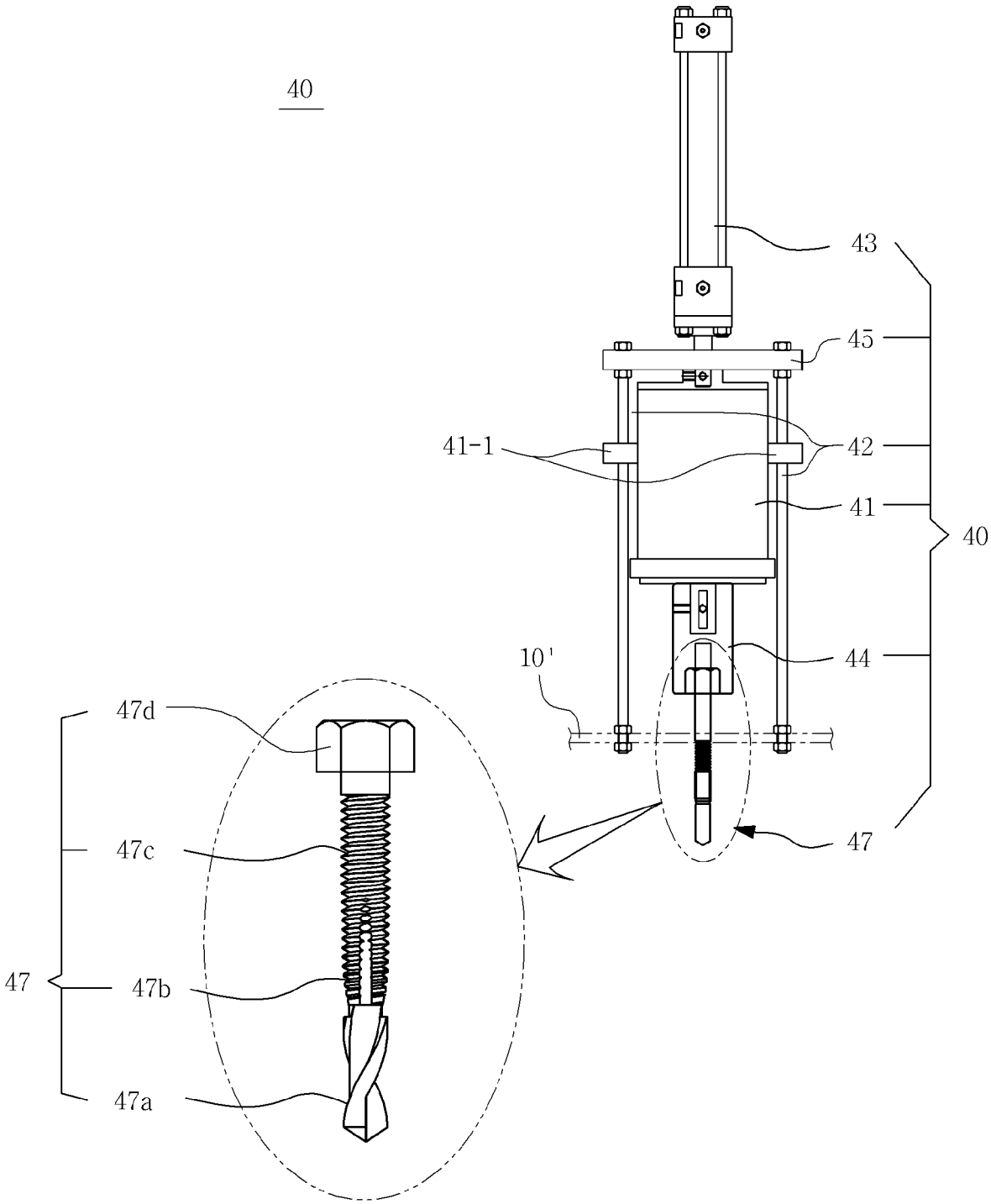

[Fig. 6]
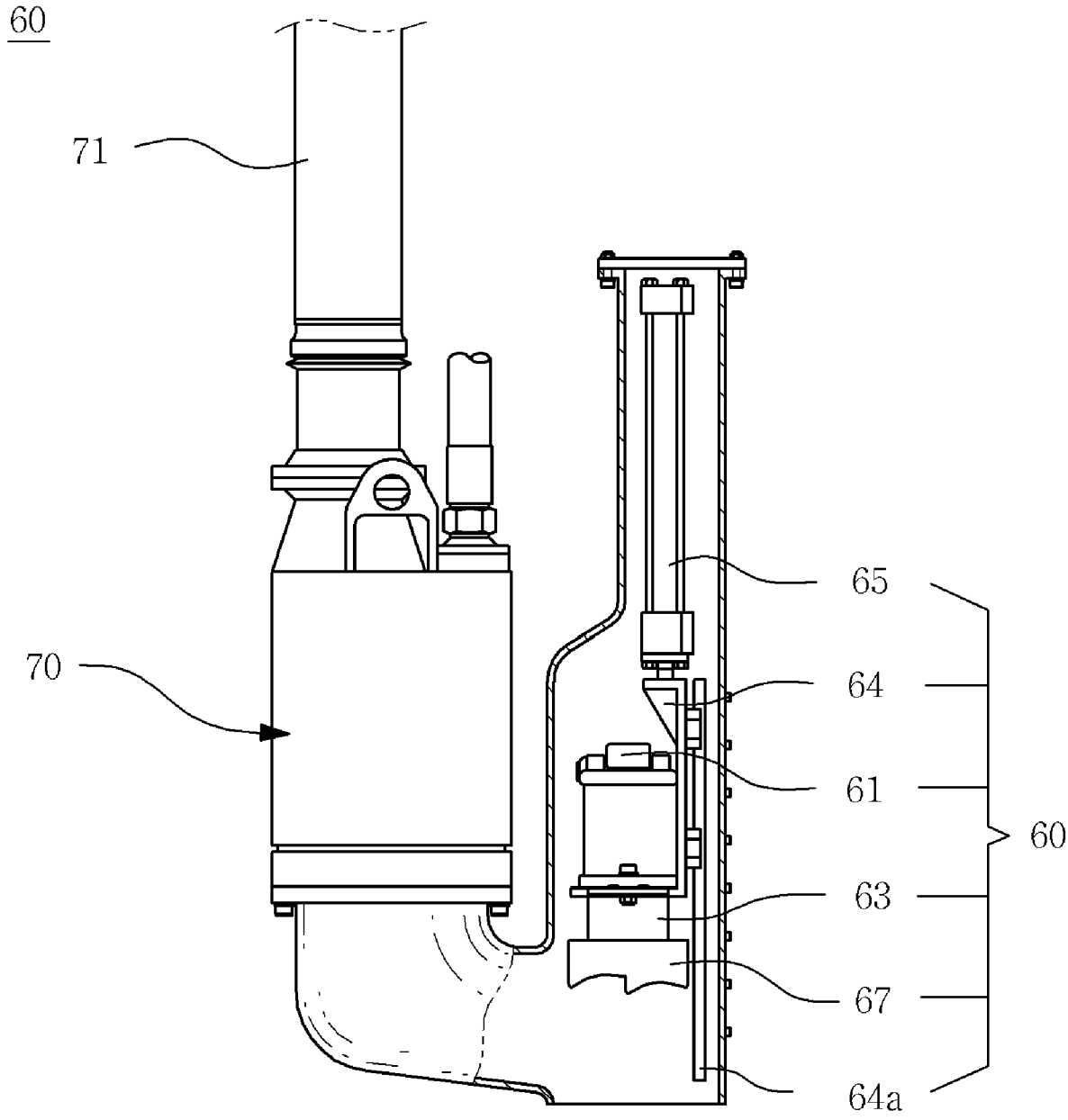

[Fig. 7]
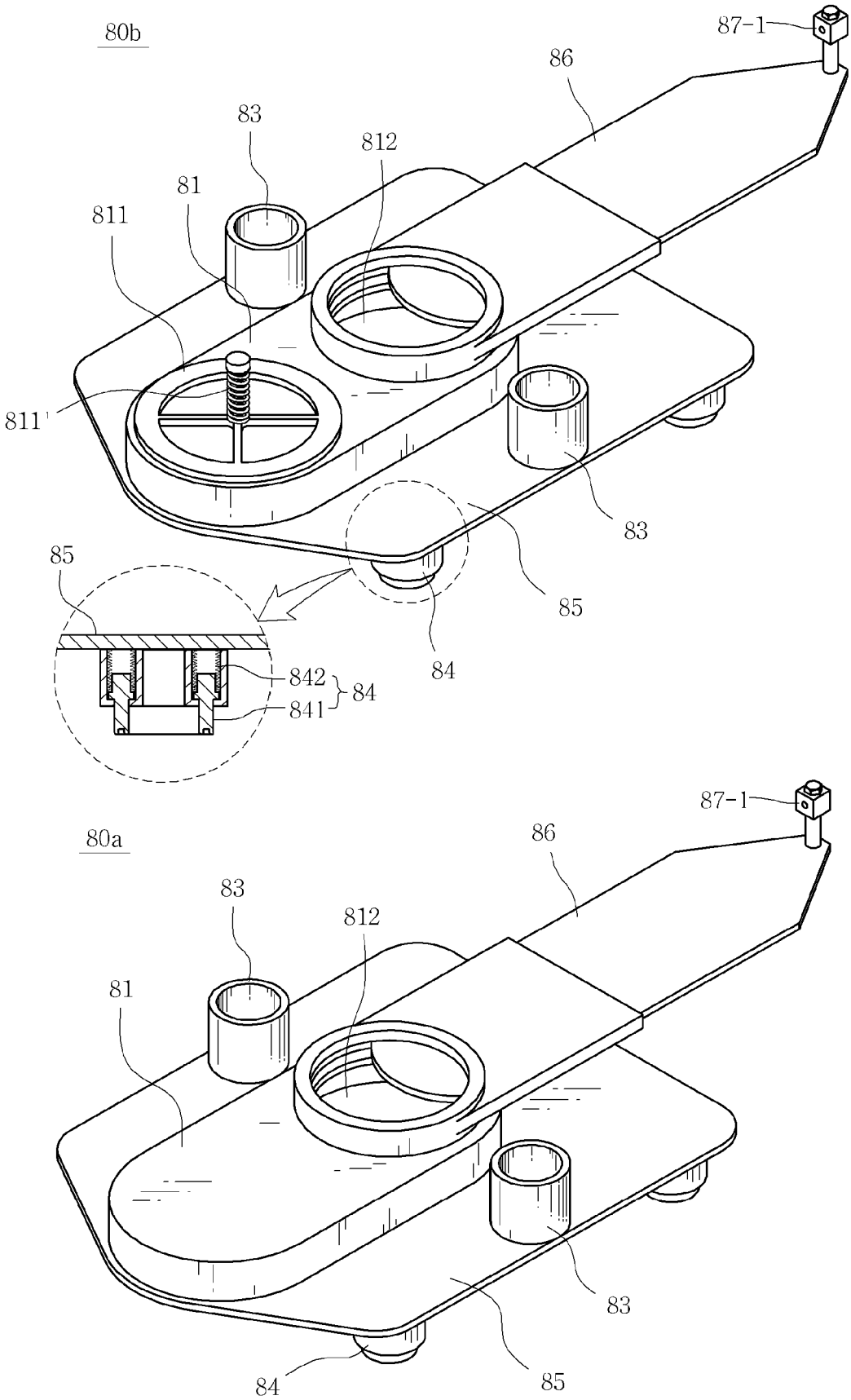

[Fig. 8]
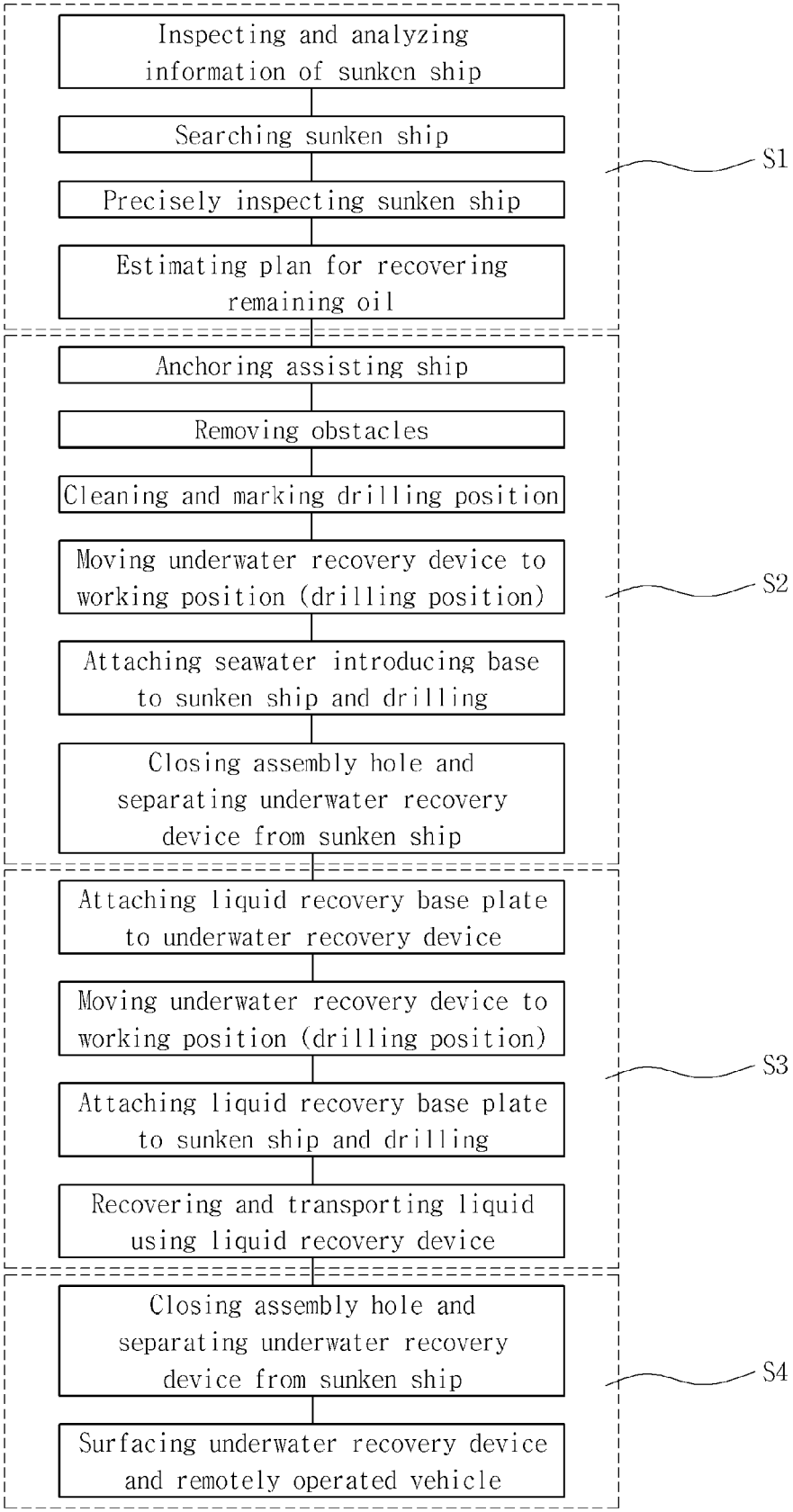

[Fig. 9]
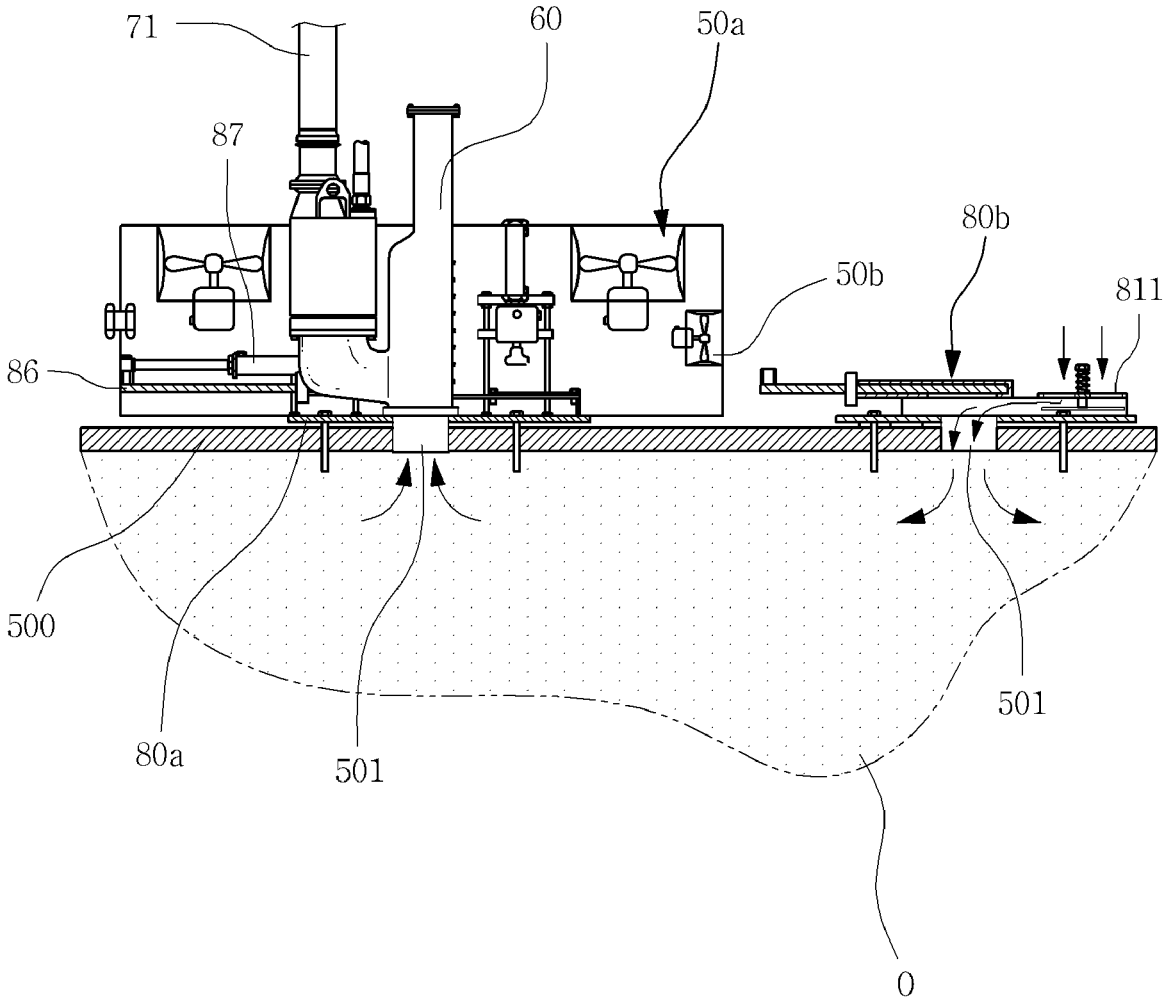

REMOTELY CONTROLLED APPARATUS FOR RECOVERING LIQUID IN SUNKEN SHIP AND METHOD PERFORMED BY THE SAME

TECHNICAL FIELD

The present invention relates to a remotely controlled apparatus for transporting liquid, such as oil, toxic chemicals, or the like, in a tank of a sunken ship to a floating body, such as ships, barges, or the like without leakage and a method performed by the apparatus, and more particularly to an apparatus for safely and rapidly recovering liquid contaminant (oil, etc), which could pollute the environment or destroy local ecosystems when the liquid contaminant leaks into the water, from sunken ships shipping the liquid contaminant, thereby remarkably minimizing damage due to the contaminant liquid and reducing environmental damage due to potential ocean pollution source.

BACKGROUND ART

Generally, liquid contaminant, remaining in sunken ships, rapidly leaks from the ship at the time that the ship sinks or slowly leaks from the ship as it rests on the ocean floor, such that the leaked contaminant causes additional ocean pollution and other accidents on sea roads or harbors. Particularly, since the sunken ship cannot be seen through water different from other ocean accidents, the sunken ship may be forgotten.

However, like all ships, sunken ships are also shipped with oil (fuel) for sailing and other liquid that can damage the ocean environment, and the ships sunken in shallow water may obstruct the safe sailing of passage of other ships on. Thus, in order to secure the safe sailing of ships and to preserve the cleanliness of the ocean environment, it is seriously required to construct an effective method of managing sunken ships, to prevent them from becoming a major source of ocean pollution, and to develop technology and apparatuses for processing the potential ocean pollution source.

DISCLOSURE OF INVENTION

Technical Problem

To this end, Korean Patent No. 239829 includes proposed technology and apparatuses for processing the potential ocean polluting source. According to this patent, when a ship containing liquid capable of destroying ecosystems or contaminating ocean environment sinks, workers directly recovery the liquid in shallow water, and the liquid is left underwater or recovered by deep diving technologies using deep diving apparatuses or remotely controlled recovery apparatuses in deep waters.

However, manual recovery of liquid contaminants requires a great deal of time and is dependent upon favorable weather and sea conditions, and, since the work is performed underwater, in view of worker safety and a long duration, the safety of the worker cannot be secured or the worker may be injured when the work goes wrong. Moreover, since a great working time and great costs are required due to time limit for the manual recovery, manually recovery is not economically viable.

Further, the recovery technology has a limitation that recovery devices cannot be attached to a curved outer plate of a tank, and has disadvantages that the recovery device is easily separated from the outer plate of the sunken ship due to weak pushing force for attaching the recovery device to the outer plate. Moreover, since a drilling machine must be separated from the outer plate of the tank by force when the drilling machine is entangled in the metal outer plate during the drilling, the recovery cannot be completed and the contaminant leaks from the tank, causing ocean pollution.

Since power cables and communication lines, used in the remote control, are affected by tidal current due to the thickness thereof, the recovery device may be separated from the outer plate of the tank during the recovery of the contaminant. As a result, the contaminant leaks from the tank to cause an additional.

Technical Solution

Therefore, the present invention has been made in view of the above problems, and it is an object of the present invention to provide a remotely controlled apparatus for safely and rapidly recovering liquid (oil, etc) that could pollute the underwater environment or destroy local ecosystems from a sunken ship without additional pollution so as to minimize damage due to the contaminant and to reduce environmental damage, and a method performed by the apparatus. In accordance with an aspect of the present invention, the above and other objects can be accomplished by the provision of a remotely controlled apparatus for recovering liquid from a sunken ship including an underwater recovery device operated underwater, a remotely operated vehicle for moving the underwater recovery device to the sunken ship, a remote controller for remotely controlling the underwater recovery device and the remotely operated vehicle, a base plate for fixing and separating the underwater recovery device to and from the sunken ship, and a transporting hose for transporting the liquid contaminant to the surface, the remotely controlled apparatus including t he underwater recovery device having a supporting plate and a supporting frame, to which a plurality of devices including a linkage, with which the underwater recovery device is coupled, are fixed, a plurality of chucking devices for fixing the underwater recovery device to the sunken ship, a grabber for attaching and detaching the base plate to the supporting frame, a plurality of DTB systems for fixedly attaching the base plate to the sunken ship, a plurality of thrusters, associated with the DTB systems, for providing a propulsive force so as to closely attach and detach the supporting frame to and from the sunken ship, a hole cutter for drilling a hole with a desired diameter for the recovery of the liquid in the sunken ship, and a liquid recovery device integrally formed with the hole cutter and having a pump for recovering the liquid through the hole drilled in the sunken ship.

Preferably, grabber includes a plurality of coupling protrusions protruded from a leading end of a body that is connected to a cylinder such that the coupling protrusions are spread in the radial direction by the cylinder to fix the base plate.

The thruster (50) includes a main thruster, installed in the same direction as the DTB system, for generating a propulsive force for moving the underwater recovery device in the direction perpendicular to the sunken ship, and an auxiliary thruster, installed perpendicular to the main thruster, for generating a propulsive force for moving the underwater recovery device parallel to the sunken ship (in the right and left directions).

In accordance with an aspect of the present invention, the above and other objects can be accomplished by the provision of a method for recovering the liquid in a sunken ship including a preparation step for analyzing and inspecting the determination of the validity of recovering the liquid in the tank of the sunken ship and the characteristics of the sea area where the ship is sunken, including the sub-steps of A1) precisely analyzing and inspecting information about sea accident and the sunken ship to estimate the possibility that the liquid contaminant such as oil remains in the sunken ship and the risk of the liquid contaminant, A2) searching the sunken ship using a marine searching device such as a site scan sonar, A3) precisely inspecting the sunken ship by divers or using a diving ship and examining the validity of recovering the liquid, and A4) establishing a plan for recovering the liquid, an attaching step (S2) for attaching a seawater introducing base plate to the sunken ship, including the sub-steps of B1) installing a navigation device and anchoring the assisting ship on the water above the place of the sunken ship, B2) precisely inspecting the sunken ship (searching and selecting a position of the sunken ship to be drilled) and removing obstacles around the sunken ship, B3) cleaning the peripherals of the drilling position and marking the drilling position, B4) moving the underwater recovery device attached with the seawater introducing base plate to the seawater introducing position (the drilling position), B5) attaching the seawater introducing base plate to the sunken ship using DTB systems and drilling the sunken ship using a hole cutter, and B6) closing assembly holes using a shutter of the seawater introducing base plate by driving a cylinder and separating the underwater recovery device from the sunken ship to which the seawater introducing base plate 80*b* is attached, a recovery step (S3) for recovering the liquid including the sub-steps of C1) mounting a liquid recovery base plate to the underwater recovery device by raising the underwater recovery device to the water surface, C2) moving the underwater recovery device to the liquid recovery position (the drilling position) in the same fashion, C3) attaching the liquid recovery base plate to the sunken ship and drilling a hole using the hole cutter, and C4) fixedly connecting the liquid recovery device and a hose for recovering the liquid to the liquid recovery base plate attached to the sunken ship and the underwater recovery device and recovering and transporting the liquid from the tank of the sunken ship to an assisting ship, and a finishing step (S4) including the sub-steps of D1) closing an assembly hole of the liquid recovery base plate when the recovery of the liquid is completed, D2) separating the underwater recovery device from the liquid recovery base plate to separate the underwater recovery device from the sunken ship, and D3) leaving the base plates on the sunken ship) and surfacing the underwater recovery device and the remotely operated vehicle.

Advantageous Effects

As described above, the remotely controlled recovery apparatus safely and rapidly recovers liquid contaminants (oil, etc), which can pollute the environment or destroy local ecosystems if they leak from the sunken ship into the surrounding waters, from the sunken ship containing the liquid contaminant s by drilling the sunken ship. The recovery apparatus is capable of being attached to the curved outer plate of the sunken ship without leakage of the liquid contaminant s in the tank of the sunken ship during the recovery of the liquid contaminant such that environmental contamination is prevented during the recovery of the liquid contaminant. The remotely controlled recovery apparatus has advantages that, since the apparatus is not operated by an underwater operator but is remotely controlled, the recovery of the liquid contaminant is safely performed. Moreover, since the recovery of the liquid contaminant is performed a long duration in comparison to the manual recovery of the liquid contaminant, it is very economically advantageous.

Moreover, since the remotely controlled recovery apparatus of the present invention can rapidly recover the liquid contaminant in ships and the structure such as containers, sunken with shipping liquid such as oil, chemical liquid, or the like, even in deep sea where divers cannot dive, environmental damage to nurseries, fisheries, or the like, around the accident site can be minimized. Further, since the remotely controlled recovery apparatus of the present invention can recover the liquid contaminant from underwater structure that can leak the liquid contaminant therein due to erosion of the outer plate of the underwater structure a long time after, additional pollution due to the leakage of the liquid contaminant can be prevented.

DESCRIPTION OF DRAWINGS

The above and other objects, features and other advantages of the present invention will be more clearly understood from the following detailed description taken in conjunction with the accompanying drawings, in which:

FIG. 1 is a view illustrating the recovery of liquid from a tank underwater according to the preferred embodiment of the present invention;

FIG. 2 is a perspective view illustrating the underwater recovery device of the remotely controlled recovery apparatus according to the preferred embodiment of the present invention;

FIG. 3 shows a front view of the underwater recovery device and an enlarged view of a grabber of the remotely controlled recovery apparatus according to the preferred embodiment of the present invention;

FIG. 4 is a plane view illustrating the underwater recovery device;

FIG. 5 shows a front view schematically illustrating the DTB system of the remotely controlled recovery apparatus according to the preferred embodiment of the present invention and an enlarged view of a DTB member of the DTB system;

FIG. 6 is a schematic view illustrating the hole cutter and the remotely controlled recovery apparatus according to the preferred embodiment of the present invention;

FIG. 7 shows perspective views illustrating the base plate attached to the sunken ship that is employed in the remotely controlled recovery apparatus of the preferred embodiment of the present invention;

FIG. 8 is a flowchart illustrating a method for recovering the liquid in the tank of the sunken ship according to the preferred embodiment of the present invention; and FIG. 9 a view illustrating the remotely controlled apparatus for recovering the liquid in the tank of the sunken ship according to the preferred embodiment of the present invention and the method performed by the apparatus.

BEST MODE

Hereinafter, the preferred embodiments of the present invention will be described in detail with reference to accompanying drawings.

FIG. 1 is a view illustrating the recovery of liquid from a tank underwater according to the preferred embodiment of the present invention.

Referring to FIG. 1, a remotely controlled apparatus for recovering liquid from a tank of a sunken ship includes an underwater recovery device 100 operated underwater, a remotely operated vehicle (ROV) 200 for moving the under water recovery device 100 to a sunken ship 500, a remote controller 300, which is installed in an assisting ship 600 on the water or other floating body to remotely control the under water recovery device 100 and the remotely operated vehicle 200, and a base plate 80 prefixed to the sunken ship 500 to fix and release the under water recovery device 100 to and from the sunken ship 500.

The under water recovery device 100 is supported and suspended by a hose 71 coupled with a linkage 111 that is provided in a supporting frame 10 such that the under water recover device 100 floats to the surface or moves to a desired working place in water by the hose 71.

Further, the ROV 200 is driven by an independent driving device and precisely moves the under water recovery device 100 to a position of the sunken ship 500.

FIG. 2 is a perspective view illustrating the underwater recovery device 100 of the remotely controlled recovery apparatus according to the preferred embodiment of the present invention, FIG. 3 shows a front view of the underwater recovery device 100 and an enlarged view of a grabber of the remotely controlled recovery apparatus according to the preferred embodiment of the present invention, and FIG. 4 is a plane view illustrating the underwater recovery device 100.

As shown in FIGS. 2 to 4, the underwater recovery device 100 basically includes a supporting plate 10' and the supporting frame 10, to which a plurality of devices including the linkage 111, with which the underwater recovery device 100 is coupled, are fixed, and further includes a plurality of chucking devices 20, provided at the central lower side of the supporting plate 10', in which a cylinder 87 for moving a short rod 87-1 connected to a shutter 86 of the base plate 80 forward and backward is installed at an end upper side of the supporting plate 10' including a plurality of electromagnets to fix the underwater recovery device 100 to the sunken ship 500, a grabber 30, provided at the lower sides of the supporting plate 10, for attaching and detaching the base plate 80 to the supporting frame 10, a plurality of DTB systems 40 for fixedly attaching the base plate 80 to the sunken ship 500 while penetrating packing members 84 of the base plate 80 during sequential performance of drilling, tapping, and bolting, thrusters 50, associated with the DTB system 40, for providing a propulsive force so as to closely attach and detach the supporting frame 10 to and from the sunken ship 500, a hole cutter 60 for drilling a hole with a desired diameter for the recovery of the liquid in the sunken ship 500 by penetrating the central portion of the base plate 80, and a liquid recovery device 70 integrally formed with the hole cutter 60 and having a pump for recovering the liquid through the drilled hole in the sunken ship 500, wherein the transporting hose 71 for transporting the liquid to the surface is connected to the liquid recovery device 70 and cables for supplying driving power and electric power to the hose 71 are connected to the hose 71.

The chucking devices 20, as shown in FIG. 3, include a plurality of electromagnets protruding downward from the lower surface of the supporting plate 10'. When electricity is applied to the electromagnets by the remote controller 200, magnetic force is generated at the electromagnets to fix the underwater recovery device 100 to the sunken ship 500 without rocking.

The grabber 30, as shown in the enlarged view of FIG. 3, includes a plurality of coupling protrusions 32 protruded from a leading end of a body 31 that is connected to a cylinder 33 such that the coupling protrusions 32 are spread in the radial direction by the cylinder 33 or contracted inward to the body 31 to fix and release the base plate 80 to and from the underwater recovery device 100. Here, reference numeral 81 is assigned to a connector of the base plate 80 and reference numeral 86 is assigned to a shutter of the base plate.

The thruster 50, as shown in FIG. 3, generates the propulsive force necessary for accurately moving the underwater recovery device 100 to be closely attached to the sunken ship 500 or for positioning the underwater recovery device 100 by working in conjunction with the DTB system 40. Here, the thruster 50 includes a main thruster 50*a* installed in the same direction as the DTB system 40 and an auxiliary thruster 50*b* installed perpendicular to the main thruster 50*a*. The main thruster 50*a* generates the propulsive force for moving the underwater recovery device 100 in the direction perpendicular to the sunken ship 500, and the auxiliary thruster 50*b* generates the propulsive force for moving the underwater recovery device 100 parallel to the sunken ship 500 (in the right and left directions).

The thruster 50, that is, the main thruster 50*a* and the auxiliary thruster 50*b* are independently operated, but if necessary, can be operated simultaneously by adjusting driving power so as to move the underwater recovery device in the diagonal direction.

FIG. 5 shows a front view schematically illustrating the DTB system 40 of the remotely controlled recovery apparatus according to the preferred embodiment of the present invention and an enlarged view of a DTB member 47 of the DTB system 40.

The DTB system 40 includes a cylinder 43 fixed to the supporting frame 10 at the upper side of the DTB system 40, fixing rods 42 fixed to a supporting member 45 that is connected to the cylinder 43, a motor 41 the upper side of which is fixed by the cylinder 43 and the sides of which are supported by the fixing rods 42 such that the motor 41 is moved up and down by the cylinder 43, a holder 44 mounted on a rotation shaft of the motor 41 and rotated by the rotating force of the motor 41, and the DTB member 47 which is detachably coupled with the holder 44 and is protruded to the lower side of the supporting plate 10' to be rotated with the holder 44, such that the DTB member 47 fixed to the holder 44 is attached to the sunken ship 500 by the rotation of the motor 41 and repetition of the vertical movement of the cylinder 43. As shown in the plan view of FIG. 4, four DTB systems 40 constitute a group such that the respective DTB systems 40 are fixed on the supporting plate 10' at the same places as the corners of a bottom plate 85 (See FIG. 7).

Referring to the enlarged view of FIG. 5, the DTB member 47 performs the drilling, tapping, and bolting, and includes a drilling part 47*a* for drilling the sunken ship 500 formed at the lower part of three divisional parts of its whole length, a screw tap part 47*b*, formed at the intermediate part of the three divisional part, for forming threads in a hole 501 of the sunken ship 500 drilled by the drilling part 47*a*, and a bolt 47*c* having a bolt head 47*d* formed at its upper end to be fastened to the drilled sunken ship 500.

The drilling part 47*a*, the screw tap part 47*b*, and the bolt 47*c* are integrally formed with each other such that the DTB member 47 forms the hole 501 and the screw tap in the sunken ship 500 and the bolt 47*c* is finally fastened in the threaded hole 501 by the DTB system 40 to fix the base plate 80 to the sunken ship 500.

Thus, in order to fix a seawater-introducing base plate 80*b* (See FIG. 7*b*) for introducing the seawater to the sunken ship 500 and a recovery base pate 80*a* (See FIG. 7) for recovering the liquid in the tank of the sunken ship 500, the cylinder 87 installed to the supporting plate 10' is connected to the short rod 87-1 of the end of the shutter 80, the underwater recovery device 100 grips the base plate 80 using the grabber 30 and is moved to a fixing position of the sunken ship 500 by the remotely operated vehicle 200. After the fixing position is determined, the DTB member 47 of the DTB system 40 can fixedly attach the base plate 80 to the sunken ship 500 by only one process. The detail description of the base plate 80 will be described later with reference to FIG. 7.

Therefore, a sequence of drilling the sunken ship 500, tapping the hole 501, and fastening the bolt 47*c* in the tapped hole 501 in water using a drilling machine is simultaneously performed by one process, so that the sequence can be rapidly and effectively performed.

FIG. 6 is a schematic view illustrating the hole cutter and the remotely controlled recovery apparatus according to the preferred embodiment of the present invention.

The hole cutter 60 drills holes 501 (See FIG. 9) with a predetermined size in assembly holes 812 of the liquid recovery base plate 80*a* prefixed to the sunken ship 500 and the seawater introducing base plate 80*b* so as to form an outlet for recovering the liquid contaminant and an inlet for introducing the seawater in the tank of the sunken ship 500.

The hole cutter 60 includes a motor 61, a holder 63 coupled with the motor 61 to rotate, a fixing bracket 64 for fixing the motor 61 and moving along a guide 64*a*, a cylinder 65, fixed to the fixing bracket 64, for providing a driving force necessary for vertically moving the fixing bracket 64, and a cutter 67 for receiving the linear motion of the cylinder 65 and the rotation of the motor 61 to form the holes 501 with the predetermined size. The hole cutter 60 drills the holes 501 needed to the sunken ship 500 using the cutter 67 vertically moved by the cylinder 65 and rotated by the motor 61.

The liquid recovery device 70 recovers the contaminant through the holes 501 drilled by the hole cutter 60 and includes a suction pump. The contaminant in the sunken ship 500 is recovered and transported to the assisting ship 600 or a barge anchored on the water through the hose 71 connected to the sunken ship 500 by the suction pump operated by an outer hydraulic source.

Here, the liquid recovery device 70 is disposed in a housing adjacent to the hole cutter 60 and to be integrally formed with the hole cutter 60 such that all the liquid that may leak from the sunken ship 500 after the drilling by the cutter 67 remains in the housing and is recovered without additional pollution of water due to the liquid.

In order to recover the liquid to the assisting ship by being connected to the liquid recovery device 170, a hydraulic hose through which hydraulic pressure is supplied from the outer hydraulic source to the hose 71 and a power cable for supplying the electricity for communication are provided.

FIG. 7 shows perspective views illustrating the base plate attached to the sunken ship that is employed in the remotely controlled recovery apparatus of the preferred embodiment of the present invention.

The base plate 80 selectively attached to and detached from the lower side of the underwater recovery device 100 is fixed to the position of the sunken ship 500 where the liquid is recovered from the sunken ship 500. The underwater recovery device 100 is fixed only to recover the liquid contaminant in the sunken ship 500, and the base plate fixed on the sunken ship 500 is left when the underwater recovery device 100 is withdrawn to complete the recovery or to repair the underwater recovery device 100 while the underwater recovery device 100 is withdrawn. Therefore, the base plate 80 is expendable.

At least two base plates 80 are fixedly attached to the sunken ship 500, one of them is used as an outlet for recovering the liquid using the underwater recovery device 100, that is, a base plate 80*a* for recovering the liquid, and the other one is used to as an inlet for introducing seawater to the tank, that is, the seawater introducing base plate 80*b*.

Here, the base plate 80 includes the assembly hole 812, which is opened and closed by a shutter 86 including the short rod 87-1 installed at the end of the base plate 80 and through which the hole cutter 60 penetrates, disposed at the upper central portion thereof, and an oval connector 81 having an internal space disposed at the lower side thereof. Particularly, the seawater introducing base plate 80*b* is formed with another assembly hole 811 having a spring valve 811' for introducing the seawater. The assembly hole 811 is communicated with the assembly hole 812 by the connector 81 to correspond to the shutter 86.

In other words, the liquid recovery base plate 80*a* does not include the seawater introducing spring valve 811' and the assembly hole 811 different from the structure of the seawater introducing base plate 80*b*, but includes only a single assembly hole 812 such that is coupled with the hole cutter 60 disposed at the upper central portion to suck and discharge the liquid in the sunken ship 500. However, the seawater introducing base plate 80*b* includes the additional assembly hole 811 having the seawater introducing spring valve 811 to introduce the seawater to the sunken ship 500.

The base plate 80 includes cylindrical fixtures 83, into which the coupling protrusions 32 of the grabber 30 are inserted, disposed at both sides of the assembly holes 811 and 812, and cylindrical packing members 84 having elastic members 841 and suction plates 842 and disposed near the corners of the lower surface of the base plate 80 to correspond to the DTB members 47. Four DTB members 47 penetrate the packing members 84 such that the base plate 80 is closely attached to the sunken ship 500.

Therefore, the base plate 80 is fixedly attached to the sunken ship 500 by the DTB systems 40 provided in the underwater recovery device 100. For the attachment of the base plate 80, that is, for the connection of the base plate 80, preferably, the thruster 50 for supplying the propulsive force to attach and detach the underwater recovery device 100 to and from the sunken ship 500 and the remotely operated vehicle 200 are simultaneously used.

The packing members 84 are made of an elastic material such as rubber. As shown in the enlarged view of FIG. 7, the elastic suction plates 842 of the elastic members 841 are coupled with the inner surface of the packing members 84, such that the elastic members 842 can move upward and downward in the suction plates 842 to closely contact the sunken ship 500 or to be inclined by a slope when the surface of the sunken ship 500 is uneven or has the slope.

The fixtures 83 and the coupling protrusions 32 of the grabber 30 are detachably installed in the base plate 80, and the cylinders 87 are also detachably connected to the short rods 87-1, so that the assembly holes 812 are closed by the shutters 86 to fix the base plate 80 to the sunken ship 500 when the underwater recovery device 100 is separated from the sunken ship 500 in order to finish the recovery or repair of the underwater recovery device 100.

As such, the chucking devices 20, the grabber 30, thruster 50, the DTBE systems 40, the hole cutter 60, and the liquid recovery device 100 necessary for operating the underwater recovery device 100 are arranged on the supporting plate 10' without interference.

The hydraulic hose for supplying the hydraulic pressure required to operate the underwater recovery device 100 and the power cable are installed in the liquid recovery device 70 together with the hose 71 for recovering the liquid contaminant. A warm water-supplying device for supplying high-temperature-and-high-pressure seawater from the assisting ship 600 when the liquid contaminant in the sunken ship 500 is gel due to the low temperature is independently provided to the liquid recovery device 70.

The remote controller 300 includes an operating switch for operating the remotely operated vehicle to move underwater, a manipulation switch for transmitting the electric power to the underwater recovery device 100 and for outputting commands of 'Start to work' and 'Finish the work' to every device, an indicator for checking the hydraulic pressure of the hydraulic devices of the underwater recovery device 100 and the hydraulic pressure source, a monitor for monitoring the underwater work image shot by an underwater CCD camera and a storage for storing the motion picture, a device for monitoring information about wind, speed and direction of a tide, and water temperature, in real time, a location tracking device for tracking relative location of the underwater recovery device 100, the assisting ship 600, and the tank of the sunken ship 500, and having a global position system (GPS), an operating device for operating a hoist and a crane for surfacing and launching the underwater recovery device 100, and a plurality of buoys, attached to the cable and the hose 71, for maintaining shapes of the cable and the hose 71 to the smooth transmission of the electricity and communication in water.

The method for recovering the liquid in the sunken ship, as shown in FIG. 8, includes a preparation step (S1) for analyzing and inspecting the validity of recovering the liquid in the tank of the sunken ship 500 and the characteristics of the sea area where the ship 500 is sunken, an attaching step (S2) for attaching the seawater introducing base plate 80*b* to the sunken ship 500, a recovery step (S3) for recovering the liquid contaminant by attaching the liquid recovery base plate 80*a* to the sunken ship 500, and a finishing step (S4) for finishing the recovery by separating the liquid recovery base plate 80*a* and the seawater introducing base plate 80*b* from the sunken ship 500.

The preparation step (S1) includes the sub-steps of precisely analyzing and inspecting information about sea accident and the sunken ship to estimate e the possibility that the liquid contaminant such as oil remains in the sunken ship 500 and the risk of the liquid contaminant by moving the remotely operated vehicle 200 to the sunken ship 500, searching the sunken ship 500 using a marine searching device such as a site scan sonar, precisely inspecting the ship 500 by divers or a diving ship, and examining the validity of recovering the liquid contaminant and establishing a plan for recovering the liquid contaminant.

Moreover, the attaching step (S2) for attaching the seawater introducing base plate 80*b* to the sunken ship 500 includes the sub-steps of installing a navigation device and anchoring the assisting ship 600 on the water above the place of the sunken ship 500, precisely inspecting the sunken ship 500 (searching and selecting a position of the sunken ship 500 to be drilled) and removing obstacles around the sunken ship 500, cleaning the peripherals of the drilling position and marking the drilling position, moving the underwater recovery device 100 attached with the seawater introducing base plate 80*b* to the seawater introducing position (the drilling position), attaching the seawater introducing base plate 80*b* to the sunken ship 500 using the DTB systems 40 and drilling the sunken ship 500 using the hole cutter 60, and closing the assembly holes 812 using the shutter 86 of the seawater introducing base plate 80*b* by driving the cylinder 87 and the short rods 87-1 and separating the underwater recovery device 100 from the sunken ship 500 to which the seawater introducing base plate 80*b* is attached.

Further, the recovery step (S3) for recovering the liquid contaminant includes the sub-steps of mounting the liquid recovery base plate 80*a* to the underwater recovery device 100 by raising the underwater recovery device 100 to the surface, moving the underwater recovery device 100 to the liquid contaminant recovery position (the drilling position) in the same fashion, attaching the liquid recovery base plate 80*a* to the sunken ship 500 and drilling a hole for recovering the liquid contaminant in the sunken ship 500 using the hole cutter 60, fixedly connecting the liquid recovery device 70 and hose 71 for recovering the liquid to the liquid recovery base plate 80*a* attached to the sunken ship 500 and the underwater recovery device 100 and recovering and transporting the liquid contaminant from the tank of the sunken ship 500 to the assisting ship 600.

The finishing step (S4) includes the sub-steps of closing the assembly hole 812 of the liquid recovery base plate 80*a* using the shutter 86 in the same fashion, when the recovery of the liquid contaminant is completed, and separating the underwater recovery device 100 from the liquid recovery base plate 80*a* to separate the underwater recovery device 100 from the sunken ship 500. Thus, the base plates 80*a* and 80*b* remain on the sunken ship 500. Finally, the underwater recovery device 100 and the remotely operated vehicle 200 are surfaced.

Operation of the remotely controlled recovery apparatus according to the preferred embodiment of the present invention will be described with reference to the above-description and FIG. 9. FIG. 9 is a view illustrating the remotely controlled apparatus for recovering the liquid in the tank of the sunken ship 500 according to the preferred embodiment of the present invention and the method performed by the apparatus.

The seawater introducing base plate 80*b* for introducing the seawater to the sunken ship 500 and the liquid recovery base plate 80*a* for recovering the liquid contaminant in the tank 0 of the sunken ship 500 are gripped by the grabber 30 installed to the supporting frame 10 in the state of opening the assembly holes 812 and contact the sunken ship 500, and are attached to the sunken ship 500 while sequentially drilling using the drilling machine, tapping to form thread in the drilled holes, and to fasten the bolts in the tapped holes by a single work. At this time, the seawater introducing base plate 80*b* is firstly attached, and the fastening can be easily performed by generating the propulsive force in the direction where the underwater recovery device is perpendicular to the sunken ship 500 by the main thruster 50*a* when attaching the base plates 80*a* and 80*b*.

The seawater is introduced into the assembly hole 811 where the spring valve 811' of the seawater introducing base plate 80*b* is installed through the hole 501, and the liquid in the tank 0 is transported into the assembly hole 812 of the liquid recovery base plate 80*a* and discharged toward the liquid recovery device 70 and the hose 71 through the other hole 501.

Therefore, the liquid contaminant of the sunken ship 500 is discharged through the liquid recovery base plate 80*a*, and the outer seawater is introduced into the sunken ship 500 through the seawater introducing base plate 80*b* simultaneously with the adjustment of pressure difference in the tank 0 due to the discharge of the liquid contaminant.

In other words, when the assembly hole 812 of the seawater introducing base plate 80*b* is closed, the seawater is introduced through the assembly hole 811 where the spring valve 811' is installed. Here, the spring valve 811 maintains the closed state when the liquid contaminant is not discharged through the liquid recovery base plate 80*a*, but since the spring valve 811' is opened depending on the pressure change in the sunken ship 500 when the liquid contaminant in the sunken ship 500 is discharged through the liquid recovery base plate 80*b*, the seawater is introduced to adjust the pressure in the tank 0 of the sunken ship 500.

Here, the hole cutter 60 and the liquid recovery device 70 are independently installed and connected to each other such that the recovered liquid contaminant is transported to the pump from the tank 0 through a connecting pipe and then is transported to the assisting ship 600.

The liquid recovery device 70 includes a check valve, installed in the pipe at the upper side of the pump, for preventing the liquid contaminant in the hose 71 at the upper side of the liquid recovery device 70 from leaking out of the pump when stopping or finishing the recovery of the liquid contaminant. After verifying that all the liquid contaminant in the tank 0 has been recovered, the electricity supplied from the remote controller 300 is interrupted to remove the magnetism of the chucking devices 20 and the grabber 30 gripping the base plate 80 is released. Then, since the underwater recovery device 100 separates the base plate 80 from the sunken ship 500, the underwater recovery device 100 is surfaced, the liquid recovery base plate 80*a* and the seawater introducing base plate 80*b* are left.

Otherwise, when re-launching the underwater recovery device 100 salved on the assisting ship 600 or the barge to perform the same work at the same position, the underwater recovery device 100 and the base plate 80 are re-coupled with each other by the grabber 30.

Moreover, an underwater illuminating device and a waterproof CCD camera, which are installed at the front side or the rear side of the underwater recovery device 100, are supplied with electricity through composition cables, information such as image information of the waterproof CCD camera and the position of the underwater recovery device 100 are transmitted to a monitor in the assisting ship 600 or the barge such that an operator confirms the state of the recovery of the liquid contaminant in real time.

The unit such as the assisting ship 600 or the barge, in which the monitor is installed, includes a terminal for sensing signals for moving the underwater recovery device 100 forward, backward, rightward, and leftward, and signals for turning the underwater illuminating device on or off. The underwater recovery device 100 includes a depth meter such that the depth information is transmitted to the remote controller and displayed on the monitor of the remote controller.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A remotely controlled apparatus for recovering liquid from a sunken ship comprising an underwater recovery device operated underwater, a remotely operated vehicle for moving the underwater recovery device to the sunken ship, a remote controller for remotely controlling the underwater recovery device and the remotely operated vehicle, a base plate for fixing and separating the underwater recovery device to and from the sunken ship, and a transporting hose for transporting the liquid to the surface, the underwater recovery device including:

a supporting plate and a supporting frame, to which a plurality of devices including a linkage, with which the underwater recovery device is coupled, are fixed;

a plurality of chucking devices for fixing the underwater recovery device to the sunken ship;

a grabber for attaching and detaching the base plate to the supporting frame;

a plurality of DTB systems for fixedly attaching the base plate to the sunken ship;

a plurality of thrusters, associated with the DTB systems, for providing a propulsive force so as to closely attach and detach the supporting frame to and from the sunken ship;

a hole cutter for drilling a hole with a desired diameter for the recovery of the liquid in the sunken ship; and a liquid recovery device integrally formed with the hole cutter and having a pump for recovering the liquid through the hole drilled in the sunken ship.

2. The remotely controlled apparatus as set forth in claim 1, wherein the grabber comprises a plurality of coupling protrusions protruded from a leading end of a body that is connected to a cylinder such that the coupling protrusions are spread in the radial direction by the cylinder to fix the base plate.

3. The remotely controlled apparatus as set forth in claim 1, wherein the thruster comprises:

a main thruster, installed in the same direction as the DTB system, for generating a propulsive force for moving the underwater recovery device in the direction perpendicular to the sunken ship; and an auxiliary thruster, installed perpendicular to the main thruster, for generating a propulsive force for moving the underwater recovery device parallel to the sunken ship.

4. The remotely controlled apparatus as set forth in claim 3, wherein the main thruster and the auxiliary thruster are simultaneously operated to move the underwater recovery device in the diagonal direction.

5. The remotely controlled apparatus as set forth in claim 1, wherein the liquid recovery device is disposed in a housing to be adjacent to the hole cutter.

6. A method for recovering liquid in a sunken ship comprising:

a preparation step for analyzing and inspecting the determination of the validity of recovering the liquid in the tank of the sunken ship and the characteristics of the sea area where the ship is sunken, including the sub-steps of:

analyzing and inspecting information about a sea accident and the sunken ship to estimate the possibility that the liquid remains in the sunken ship and a risk of the liquid;

searching the sunken ship using a marine searching device;

inspecting the sunken ship by divers or using a diving ship and examining the validity of recovering the liquid; and establishing a plan for recovering the liquid;

an attaching step for attaching a seawater introducing base plate to the sunken ship, including the sub-steps of:

installing a navigation device and anchoring an assisting ship on the water above the sunken ship;

inspecting the sunken ship and removing obstacles around the sunken ship;

cleaning peripherals of the drilling position and marking the drilling position;

moving an underwater recovery device attached with the seawater introducing base plate to a seawater introducing position;

attaching the seawater introducing base plate to the sunken ship using DTB systems and drilling the sunken ship using a hole cutter; and closing assembly holes using a shutter of the seawater introducing base plate by driving a cylinder and separating the underwater recovery device from the sunken ship to which the seawater introducing base plate is attached;

a recovery step for recovering the liquid including the sub-steps of:

mounting a liquid recovery base plate to the underwater recovery device by raising the underwater recovery device to the water surface;

moving the underwater recovery device to a liquid recovery position;

attaching the liquid recovery base plate to the sunken ship and drilling a hole using the hole cutter; and fixedly connecting a liquid recovery device and a hose for recovering the liquid to the liquid recovery base plate attached to the sunken ship and the underwater recovery device and recovering and transporting the liquid from the tank of the sunken ship to the assisting ship; and a finishing step including the sub-steps of:

closing an assembly hole of the liquid recovery base plate when the recovery of the liquid is completed;

separating the underwater recovery device from the liquid recovery base plate to separate the underwater recovery device from the sunken ship; and leaving the base plates on the sunken ship and surfacing the underwater recovery device and the remotely operated vehicle.

* * * * *